US005694875A

United States Patent [19]

Cash

[11] Patent Number: 5,694,875

[45] Date of Patent: Dec. 9, 1997

[54] BORDER SERGER

[75] Inventor: David R. Cash, Louisville, Ky.

[73] Assignee: James Cash Machine Co., Inc., Louisville, Ky.

[21] Appl. No.: 618,945

[22] Filed: Mar. 20, 1996

[51] Int. Cl.[6] ..... D05B 25/00; D05B 27/12

[52] U.S. Cl. ..... 112/470.12; 112/470.33; 112/155

[58] Field of Search ..... 112/470.33, 470.12, 112/475.08, 2.1, 155, 305, 307, 318, 322, 277

[56] References Cited

U.S. PATENT DOCUMENTS

| | | | |
|---|---|---|---|
| 3,837,305 | 9/1974 | Cash | 112/2.1 X |
| 4,013,027 | 3/1977 | Cash | 112/2.1 X |
| 4,061,096 | 12/1977 | Elsas | 112/155 X |
| 4,989,526 | 2/1991 | Brusini | 112/155 X |

*Primary Examiner*—Peter Nerbun

*Attorney, Agent, or Firm*—Middleton & Reutlinger; James C. Eaves, Jr.

[57] ABSTRACT

A border serger, used in the bedding industry, the serger having a left-hand and a right-hand sewing head, positioned approximately in a common horizontal plane, permitting border serging of both edges of one piece of border, or simultaneous border serging of one side of two pieces of border. The respective lateral spacing of the sewing heads can be adjusted as desired, for example, by having a motor driven acme threaded screw rod connected to the left-hand sewing head. A pair of pull rollers downstream of the sewing heads are used to pull the one or two pieces of border material past the sewing heads for serging. Typically, a border may be serged only along one side for the border to be used in box springs manufacture and serged along both sides for a border to be used in mattress manufacture.

12 Claims, 3 Drawing Sheets

BORDER SERGER

BACKGROUND OF THE INVENTION

1. Field of the Invention

This application is for a border serger, used in the bedding industry, the serger having a left-hand and a right-hand sewing head, positioned approximately in a common horizontal plane, permitting border serging of both edges of one piece of border, or simultaneous border serging of one side of two pieces of border. Typically, a border may be serged only along one side for the border to be used in box springs manufacture and serged along both sides for a border to be used in mattress manufacture.

2. Description of the Prior Art

Known border serging machines, made by the James Cash Machine Company and others generally employ a pair of right handed sewing heads. In the BS75-MC Border Serger, by Cash Machine, the pre-serged border input and post-serged border output reels were on the same side of the serging machine. One of the right-handed sewing heads was at a first horizontal level and sewed one side of a single piece of border. After the first side of the border was serged, the border material then looped downward and outward where the second right-handed sewing head serged the second side of the border.

Another border serging machine produced by Cash Machine had two right-hand sewing heads, with the pre-serged border input and post-serged border output reels at ninety degree angles to each other. The pre-serged border was input to a first right-hand sewing head where the border was serged along one side of the border material. The border material had a first face upward at this time. After the first side was serged, the border material passes over a guide which is at a forty-five degree angle to the border material. This guide turns the material over so that the border material with one side serged now has its second, or reverse, face upward. This provides the ninety degree relationship between the pre-serged and post-serged border material. The border material with one side serged and the second face upward is now passed through the second right-hand sewing head where the second side of border is serged.

SUMMARY OF THE INVENTION

The present invention relates to a border serger machine employable, for example, in box spring and mattress manufacturing. Typically, prior to border serging, a multi-needle quilting machine is used to sew a desired pattern on a mattress or box spring panel piece. The piece may include a ticking and a filler such as foam. The quilted panel is then typically passed through a panel cutter where the panel is cut into a plurality of border pieces of desired width. Often, a panel is cut into nine border strips. The border is the piece which will go around the sides of the mattress or box springs. A mattress border piece transits the border serger of the instant invention and is serged along both sides, for later use with a tape edge machine in producing a mattress. Alternatively, the border piece for use in a box spring is only serged along one side, as the underneath portion of a box spring generally has the border piece simply stapled to the box spring frame, so serging of that side is not necessary.

The border serger of the instant invention includes a frame having a right-hand sewing head and a left-hand sewing head in a generally horizontal plane. The sewing heads are adjustable with respect to each other. This adjustability permits the heads to be spaced for serging two sides of a piece of border or, simultaneously, for serging one side of two individual pieces of border. The pre-serged border input roll(s) is/are at the front of the machine and the post-serged border output roll(s) is/are at the rear of the machine. The border material is pulled through the machine by a pair of pull rollers downstream of the sewing heads. The machine of speeds of about 150 feet of border a minute, or higher. In contrast, prior art machines were only able to operate at maximum speeds of about 121 feet of border a minute. At speeds such as 150 feet a minute, the pull rollers and sewing heads should ramp up to and down from this rate.

Finally, the present invention comprises a border serger having a front and a rear and a left side and a right side, the border serger having a frame assembly including a pre-serged border support at the front, the frame assembly having a right-hand sewing head toward the right side and a left-hand sewing head toward the left side, the left-hand sewing head being laterally adjustable with respect to the right-hand sewing head, means for pulling at least one strip of border material from the pre-serged border support toward the rear, the means for pulling being at a downstream location from the right-hand and the left-hand sewing heads, and means for synchronized operation of the sewing heads and the pulling means; where, when the right-hand and the left-hand sewing heads are in a first desired spaced relationship, the right-hand sewing head and the left-hand sewing heads serge opposed sides of a single piece of border material, and, when the right-hand and the left-hand sewing heads are in a second desired spaced relationship, the right-hand sewing head serges a right side of a first piece of border material and the left-hand sewing head serges a left side of a second piece of border material.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
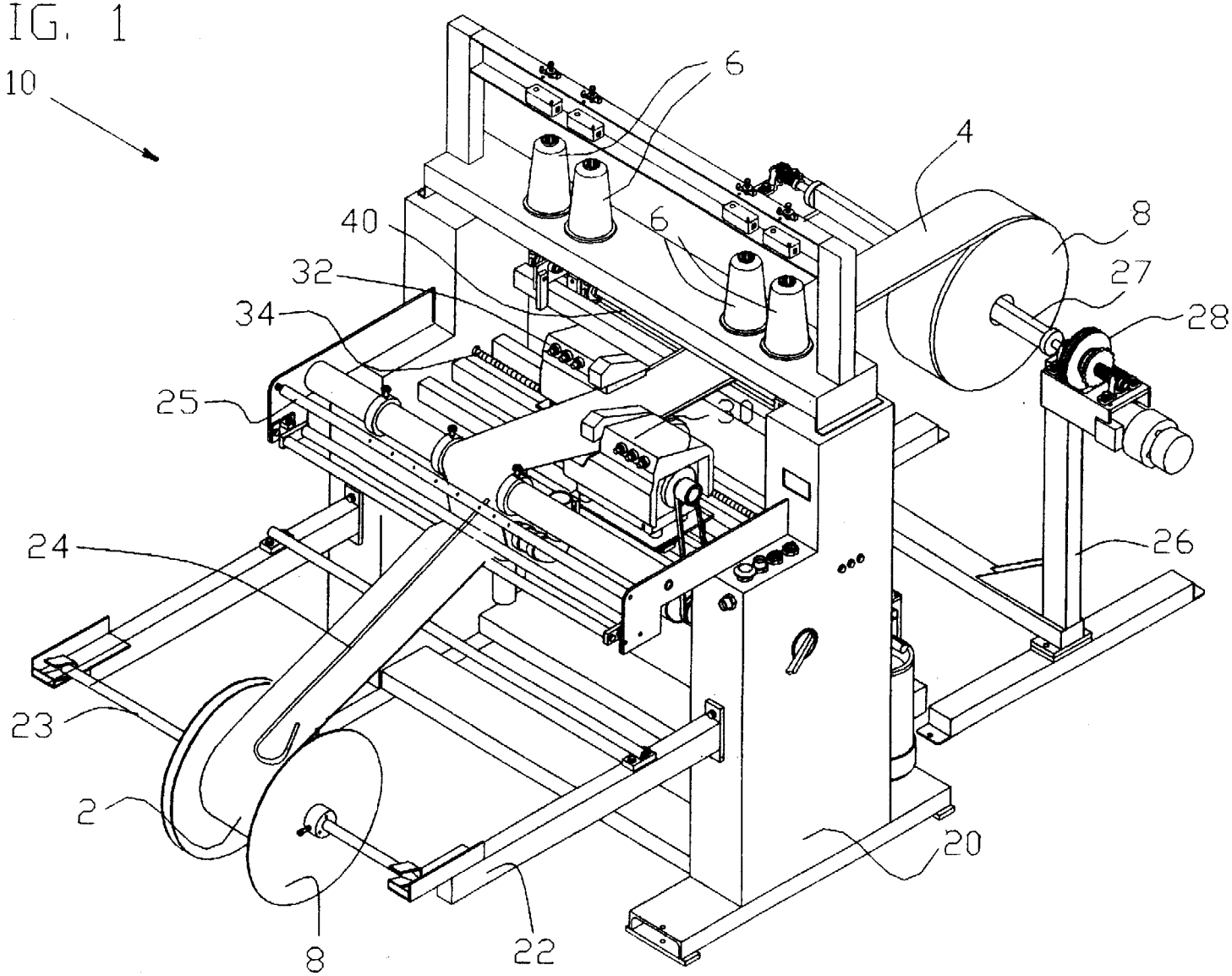
FIG. 1 shows a front side perspective view of a serging machine of the present invention with one strip of border material passing therethrough.

With reference to FIG. 1, the serging machine 10 of the instant invention is shown having a frame assembly 20, including a pre-serged border support 22 and a post-serged border support 26. Support 22 includes a rod 23 for supporting at least one spool 8 having pre-serged border material thereon. Support 26 provides for take-up of the serged border material 4 on, for example, a spool 8. Support 22 is at the front of machine 10 and support 26 at the rear.

Frame assembly 20 includes a right-hand sewing head 30, for example, a PEGASUS model 504E52130, and a left-hand sewing head 32, for example, a PEGASUS model 504E52L130, for sewing a two-thread 6 serge stitch. Heads 30/32 generally lie in a common horizontal plane and are adjustable laterally with respective to each other. Head 32 is connected to an acme thread screw rod 34, which is motor driven. Rod 34 is turned to position head 32 laterally with respect to head 30. For example, is one piece of border material is to be serged on both sides, heads 30/32 may be spaced for a lateral separation of about eleven inches. Alternatively, as will be seen in FIGS. 2 and 3, if two pieces of border are to be serged on a single side of each, heads 30/32 may be spaced for a lateral separation of about 24 inches. Wider or narrower lateral spacing is possible for the desired application. It is noted that head 30 is upstream in sewing direction from head 32, meaning head 30 serges the material before head 32, which is downstream. The referred to lateral spacing is the distance on a side to side line perpendicular to a line along either edge or side of the border material, not a diagonal distance between needles on heads 30/32.

A horizontal rod 25 receives at least one rod such as crook-shaped rod 24 which rests atop the border material 2 to be serged. When all material 2 to be serged exits the spool 8, the material 2 no longer supports rod 24. Rod 24 moves downward thereby rotating rod 25. This rotation activates a microswitch which causes the means 40 pulling the material through the machine, discussed later with FIG. 3, and the sewing heads 30/32 to ramp down slowly in speed. The speed of means 40 and heads 30/32 are synchronized. For example, when means 40 is pulling material 4 at a rate of about 150 feet per minute, heads 30/32 are operating at about 6,500 rpm. In addition to ramping down in speed, means 40 and heads 30/32 ramp up in speed also to prevent breakage or damage, particularly to the sewing heads 30/32.

Post-serge border support 26 provides for take-up of serger border material 4, for example on a spool 8. A horizontal bar 27 is driven by assembly 28 to roll up material 4. The movement of bar 27 can be synchronized to means 40 and heads 30/32, or, preferably, can be independent of them. As shown, bar 27 rotates until material 4 is taut from means 40 to spool 8, wherein a clutch/breaking assembly stops bar 27 from being driven. When material 4 is slack, bar 27 is again driven.

Figure 2:
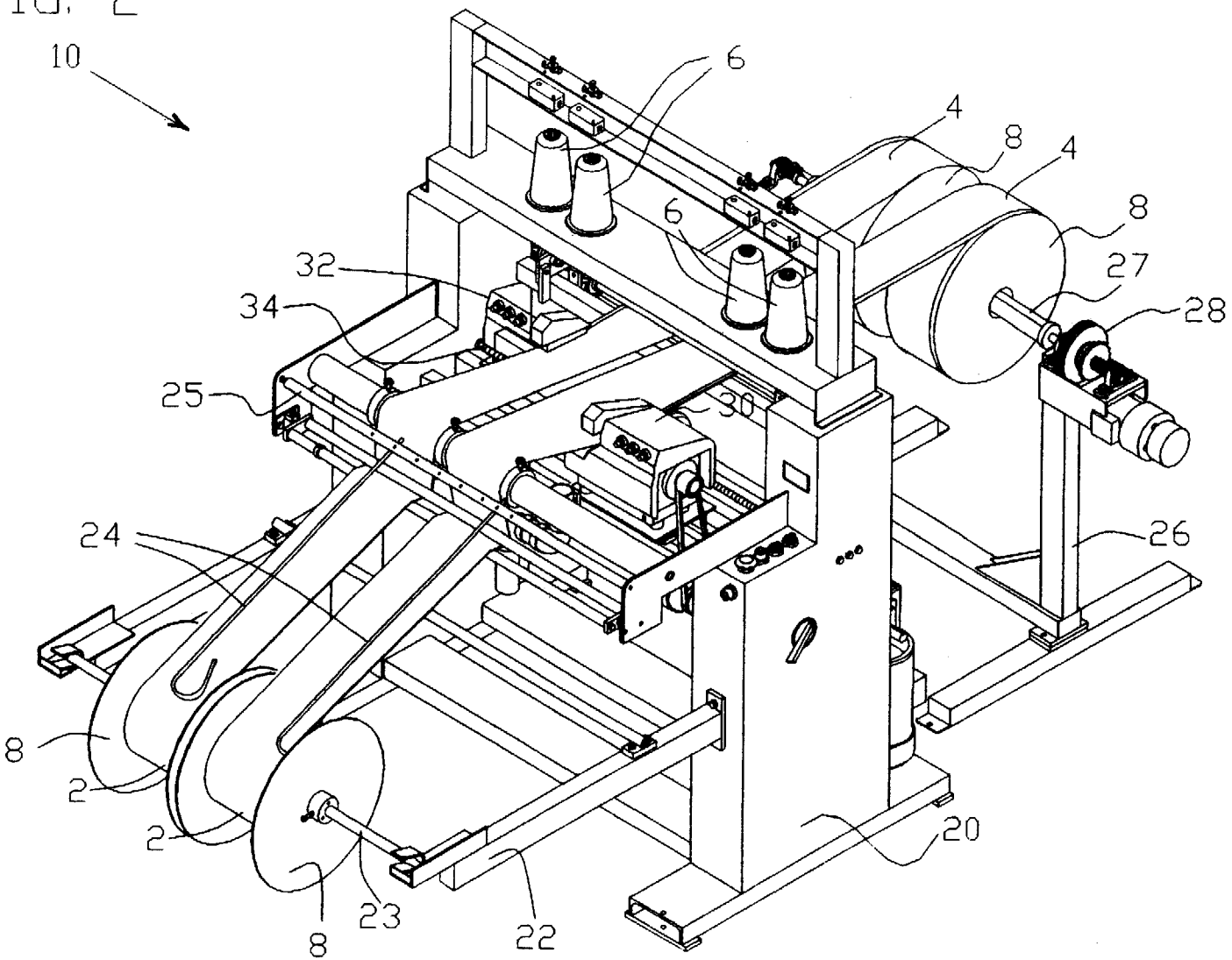
FIG. 2 shows a front side perspective view of a serging machine of the present invention with two strips of border material passing therethrough.

With reference to FIG. 2, machine 10 is shown with heads 30/32 spaced laterally further apart than the spacing of FIG. 1. Head 32, using screw rod 34 has been moved further to the left from that position shown in FIG. 1 so that one edge on each of two pieces of border material 2 can be serged, one piece by head 30 and one piece by head 32.

Rod 25 is shown having two crook shaped rods 24 extending therefrom, one rod 24 resting atop the border material 2 on the left and one rod 24 resting atop the border material 2 on the right. When both spools 8 are empty of material 2, rods 24 will move downward causing the microswitch to ramp down the speed of means 40 and heads 30/32.

When a pair of spools 8 each having border material 2 of approximately equal length are placed on rod 23, this is satisfactory. However, if two spools 8 each having a different length of border material thereon, rod 25 should be split so that the left side having the left rod 24 can rotate independently of the right side having the right rod 24. Two microswitches will be used, one for the left side and one for the right side. Then, when either rod 24 senses an "out of material" condition, means 40 and heads 30/32 can be ramped down in speed. Even further, a switch can be provided so that either head 30/32 can be operated at a reduced speed to finish off the remaining material 2/4.

Figure 3:
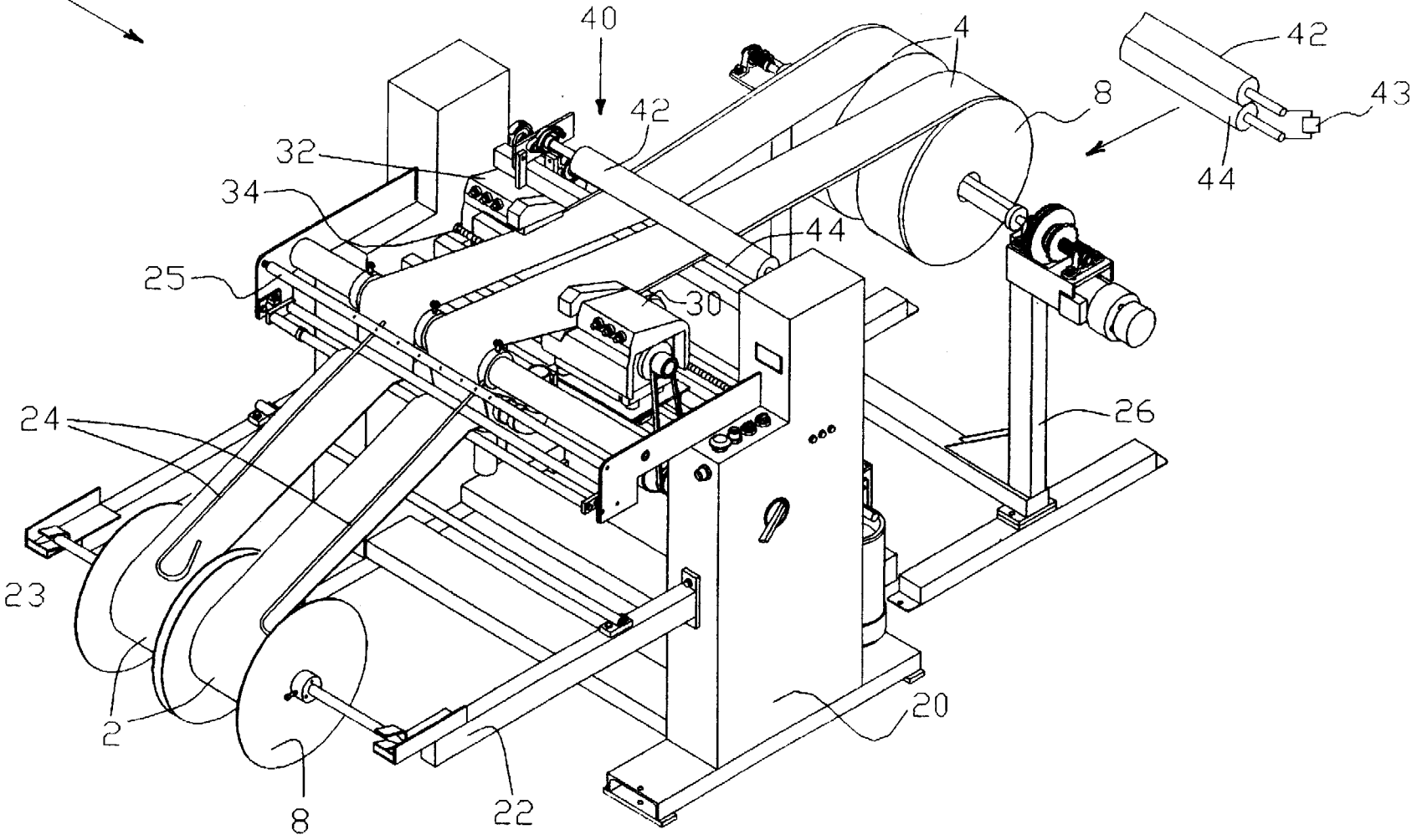
FIG. 3 shows the serging machine of FIG. 2, the machine having the top portion of the frame assembly removed for clarity so that the pull roller assembly is visible and, FIG. 4 shows the pull roller assembly and tensioning means for the serging machine of FIG. 1.

With reference to FIG. 3, machine 10 of FIG. 2 is shown having the upper portion of frame assembly 20 removed for clarity. It was previously mentioned that pulling means 40, downstream of heads 30/32 pulls border material 2/4 through the machine 10. Means 40 is shown having an upper roller 42 and a lower roller 44. Generally, one of rollers 42 and 44 is connected to a driving means, not shown. Typically that would be roller 44. Desirably, roller 42 would be liftable away from roller 44 for easy insertion of material 2/4 therebetween. Preferably, spring means 43 shown in FIG. 4, is used for desired tensioning between rollers 42/44. As was previously mentioned, pulling means 40 and heads 30/32 are synchronized by, for example, a 5 horsepower very high frequency ac driving unit.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A border serger having a front and a rear and a left side and a right side, said border serger comprising: a frame assembly, including a pre-serged border support at said front, said frame assembly having a right-hand sewing head toward said right side of said border serger and a left-hand sewing head toward said left side of said border serger, said left-hand sewing head being laterally adjustable with respect to said right-hand sewing head, means for pulling at least one strip of border material from said pre-serged border support toward said rear, said means for pulling being at a downstream location from said right-hand and said left-hand sewing heads, and means for synchronized operation of said sewing heads and said pulling means; where, when said right-hand and said left-hand sewing heads are in a first desired spaced relationship, said right-hand sewing head and said left-hand sewing heads serge opposed sides of a single piece of border material, and, when said right-hand and said left-hand sewing heads are in a second desired spaced relationship, said right-hand sewing head serges a right side of a first piece of border material and said left-hand sewing head serges a left side of a second piece of border material.

2. The border serger of claim 1, said means for pulling comprising a first driven roller and a second roller, said first driven roller and said second roller having means for tensioning therebetween.

3. The border serger of claim 1, further comprising a motor operable screw rod connected to said left-hand sewing head, where operation of said screw rod causes lateral adjustment of said left-hand sewing head with respect to said right-hand sewing head.

4. The border serger of claim 3, where said screw rod contains acme threads.

5. The border serger of claim 1, further comprising means for sensing when said pulling means has pulled all of said at least one strip of border material from said pre-serged border support.

6. The border serger of claim 5, said sensing means further including means for ramping down from an operational speed to a complete stop for said means for synchronized operation of said sewing heads and said pulling means.

7. The border serger of claim 6, where said ramping means includes a horizontal bar having at least one perpendicular bar connected thereto, said at least one perpendicular bar being retained in a first position by said single piece of border material, said at least one perpendicular bar being movable to a second position when said pulling means has pulled all of said single piece of border material from said pre-serged border support thereby activating said ramping means.

8. The border serger of claim 6, where said ramping means includes a horizontal bar having a first and a second perpendicular bar connected thereto, said first perpendicular bar being retained in a first position by said first piece of border material, said first perpendicular bar being movable to a second position when said pulling means has pulled all of said first piece of border material from said pre-serged border support thereby activating said ramping means, said second perpendicular bar being retained in said first position by said second piece of border material, said second perpendicular bar being movable to said second position when said pulling means has pulled all of said second piece of border material from said pre-serged border support thereby activating said ramping means.

9. The border serger of claim 3, further comprising means for sensing when said pulling means has pulled all of said at least one strip of border material from said pre-serged border support.

10. The border serger of claim 9, said sensing means further including means for ramping down from an operational speed to a complete stop for said means for synchronized operation of said sewing heads and said pulling means.

11. The border serger of claim 10, where said ramping means includes a horizontal bar having at least one perpendicular bar connected thereto, said at least one perpendicular bar being retained in a first position by said single piece of border material, said at least one perpendicular bar being movable to a second position when said pulling means has pulled all of said single piece of border material from said pre-serged border support thereby activating said ramping means.

12. The border serger of claim 10, where said ramping means includes a horizontal bar having a first and a second perpendicular bar connected thereto, said first perpendicular bar being retained in a first position by said first piece of border material, said first perpendicular bar being movable to a second position when said pulling means has pulled all of said first piece of border material from said pre-serged border support thereby activating said ramping means, said second perpendicular bar being retained in said first position by said second piece of border material, said second perpendicular bar being movable to said second position when said pulling means has pulled all of said second piece of border material from said pre-serged border support thereby activating said ramping means.

* * * * *